US010840053B2

(12) United States Patent
Schultheis et al.

(10) Patent No.: US 10,840,053 B2
(45) Date of Patent: Nov. 17, 2020

(54) RECEPTACLE FOR RECEIVING A PLUG CONNECTOR OF A HIGH-VOLTAGE CABLE FOR A MICROFOCUS X-RAY TUBE, PLUG CONNECTION FOR A HIGH-VOLTAGE CABLE

(71) Applicant: YXLON INTERNATIONAL GMBH, Hamburg (DE)

(72) Inventors: Lothar Schultheis, Oftringen (CH); Bjoern Schrader, Hamburg (DE)

(73) Assignee: YXLON INTERNATIONAL GMBH, Hamburg (DE)

( * ) Notice: Subject to any disclaimer, the term of this patent is extended or adjusted under 35 U.S.C. 154(b) by 223 days.

(21) Appl. No.: 15/921,774

(22) Filed: Mar. 15, 2018

(65) Prior Publication Data

US 2018/0277331 A1 Sep. 27, 2018

(30) Foreign Application Priority Data

Mar. 15, 2017 (DE) ..... 10 2017 105 546

(51) Int. Cl.
*H01R 4/48* (2006.01)
*H01J 35/16* (2006.01)
(Continued)

(52) U.S. Cl.
CPC ..... *H01J 35/165* (2013.01); *H01J 1/90* (2013.01); *H01J 35/045* (2013.01); *H01J 35/06* (2013.01); *H01J 35/14* (2013.01); *H01J 35/22* (2013.01); *H01J 1/15* (2013.01); *H01J 2235/0233* (2013.01); *H01J 2235/06* (2013.01); *H01R 4/48* (2013.01); *H01R 13/02* (2013.01); *H01R 13/53* (2013.01); *H01R 13/533* (2013.01); *H01R 13/6485* (2013.01); *H01R 13/6666* (2013.01); *H01R 24/48* (2013.01)

(58) Field of Classification Search
CPC .. H01R 13/53; H01R 13/533; H01R 13/6485; H01R 13/6666; H01R 24/48; H01R 4/48; H01R 13/02; H01J 35/165; H01J 1/90; H01J 35/22; H01J 35/045; H01J 2235/0233
USPC ..... 439/88, 181, 322, 349
See application file for complete search history.

(56) References Cited

U.S. PATENT DOCUMENTS 5,105,456 A * 4/1992 Rand ..... H01J 35/106 378/125
2005/0233627 A1* 10/2005 Hansen ..... H01R 13/53 439/281

* cited by examiner

*Primary Examiner* — Abdullah A Riyami
*Assistant Examiner* — Justin M Kratt
(74) *Attorney, Agent, or Firm* — Abelman, Frayne & Schwab

(57) ABSTRACT

A receptacle for receiving a plug connector of a high-voltage cable for a microfocus X-ray tube with a cathode, which has a metal filament and grid cap. The receptacle has a ceramic insulator with three contiguous cavities. The first cavity near the filament includes electrical contacts for the filament and the grid cap. The second cavity includes spring contacts for supplying current to the filament and a center pin for supplying voltage to the grid. The third cavity receives the plug connector. The insulator has a removable grid mounting which is conductively connected to the grid cap of the cathode. The first and second cavities are surrounded in the radial direction by the grid mounting. An air gap extends radially between grid mounting and ceramic body. At the end of the grid mounting remote from the filament is a circumferential groove in the axial direction between the grid mounting and the ceramic insulator.

11 Claims, 3 Drawing Sheets

(51) Int. Cl.

| | |
|---|---|
| ***H01J 35/22*** | (2006.01) |
| ***H01J 35/04*** | (2006.01) |
| ***H01J 35/14*** | (2006.01) |
| ***H01J 35/06*** | (2006.01) |
| ***H01J 1/90*** | (2006.01) |
| *H01J 1/15* | (2006.01) |
| *H01R 13/648* | (2006.01) |
| *H01R 13/533* | (2006.01) |
| *H01R 24/48* | (2011.01) |
| *H01R 13/02* | (2006.01) |
| *H01R 13/66* | (2006.01) |
| *H01R 13/53* | (2006.01) |

RECEPTACLE FOR RECEIVING A PLUG CONNECTOR OF A HIGH-VOLTAGE CABLE FOR A MICROFOCUS X-RAY TUBE, PLUG CONNECTION FOR A HIGH-VOLTAGE CABLE

CROSS-REFERENCE TO RELATED APPLICATIONS

This application is related to and claims priority under 35 U.S.C. § 119(a) to German patent application No. 102017105546.0, filed Mar. 15, 2017, the contents of which are incorporated by reference herein in its entirety.

FIELD OF THE INVENTION

The invention relates to a receptacle for receiving a plug connector of a high-voltage cable for a microfocus X-ray tube with a cathode, which has a filament and a grid mounting made of metal, as well as to a plug connection for a high-voltage cable for a microfocus X-ray tube, which has a plug connector and such a receptacle.

BACKGROUND OF THE INVENTION

The transmission of high voltage from the outside of an open microfocus X-ray tube to the inside—the cathode chamber—of this X-ray tube under high vacuum can lead to voltage flashovers. The operation of such X-ray tubes is badly disrupted by such voltage flashovers. By microfocus X-ray tubes is meant X-ray tubes which have a focal spot (focus) in the μm range. In contrast, "normal" X-ray tubes have an effective size in the mm range.

For certain applications, it is advantageous if the X-ray tube is operated with a high voltage. For this, for the transmission of the high voltage and of the electrical current, a receptacle made of an epoxy resin as insulator has been used, for example in the case of the applicant's FXE-225 model. Through the encapsulation of the electrical connection with epoxy resin, voltage flashovers due to high field strengths are to be prevented. One problem here is, however, that epoxy plastics emit gas and thus impair the vacuum. The use of ceramic materials for the receptacle could alleviate this problem—as has already been done hitherto in the case of closed X-ray tubes—however, the problem arises here that high field strengths develop in the contact area between the plug connector and the receptacle and voltage flashovers caused thereby occur, which are precisely to be prevented. Unlike with the use of epoxy resins, it is not possible with ceramics to encapsulate the electrical contacts in order to guarantee sufficient dielectric strength.

SUMMARY OF THE INVENTION

An object of the invention is to provide a receptacle and a plug connection for a high-voltage cable for a microfocus X-ray tube, in which no voltage flashovers occur even at high voltages.

The object is achieved by a plug connector with the features of claim 1. In order to prevent voltage flashovers at high voltages in the plug connection, the receptacle according to the invention is equipped with a combination of three features. Firstly, the use of spring contacts for the transmission of the filament current from the high-voltage cable via the high-voltage plug connector to the filament; narrow gaps and thus high field strengths are thereby prevented. Secondly, the use of an extended grid mounting of the cathode; shielding of the field in the area of the plug connection is thereby achieved, which reduces the field strength there. Thirdly, the use of internal metallization of the insulator in the area of the current and voltage transmission when the high-voltage plug connector of the high-voltage cable is inserted (thus, in the second cavity of the ceramic insulator); the field strength is also reduced by this. As a result of the above-named three cumulative measures according to the invention an enormous reduction in the field strengths developing in the area of the plug connection is achieved, with the result that high voltages can be applied to the microfocus X-ray tube with a small constructed size without voltage flashovers being produced. As a result of the described features according to the invention, ceramic material can thus be used in spite of the problems described above, which have until now deterred a person skilled in the art from using ceramic for microfocus X-ray tubes having a small constructed size, since these measures lead to the described drastic reduction in the field strength at the relevant points.

An advantageous development of the invention provides that the second cavity is formed cylindrical over the bulk of its axial length.

A further advantageous development of the invention provides that the third cavity is formed frustoconical over the bulk of its axial length. High-voltage cables with high-voltage plug connectors known from the state of the art, which have a corresponding shape, can thereby still be used and a surface contact forms all over without air pockets.

The object is also achieved by a plug connection with the features as set forth in the dependent claims. The advantages stated there result hereby analogously for the reasons already named above in relation to claim 1.

An advantageous development of the invention provides that the second area of the high-voltage plug connector has a rubber cone and/or the second area of the high-voltage plug connector is frustoconical. By means of the rubber coating in the form of the rubber cone over an HV flange the high-voltage plug connector can be pushed into the receptacle under pressure to fit precisely, with the result that there is a surface contact between receptacle and high-voltage plug connector over the whole surface and no gaps form between high-voltage plug connector and receptacle (or the ceramic insulator thereof); gaps would increase the risk of voltage flashovers. The use of frustoconical high-voltage plug connectors has the advantage that common high-voltage plug connectors can be used since these have such a shape.

The object is also achieved by the use of a receptacle according to the invention and/or of a plug connection according to the invention with the features as set forth in the dependent claims. The applied high voltage is at least 160 kV preferably at least 250 kV and particularly preferably at least 320 kV. The microfocus X-ray tube can thus accommodate very high voltages with a small constructed size of the plug connection—which also makes possible a small constructed size for the whole microfocus X-ray tube—which leads to a widening of the range of application of such X-ray tubes.

All of the features of the advantageous developments indicated in the dependent claims form part of the invention both individually per se in each case and also in any desired combinations.

DETAILED DESCRIPTION OF THE INVENTION

In the following, an advantageous embodiment example of a receptacle according to the invention is explained in the context of its connection to a cathode of an open microfocus X-ray tube.

Figure 1:
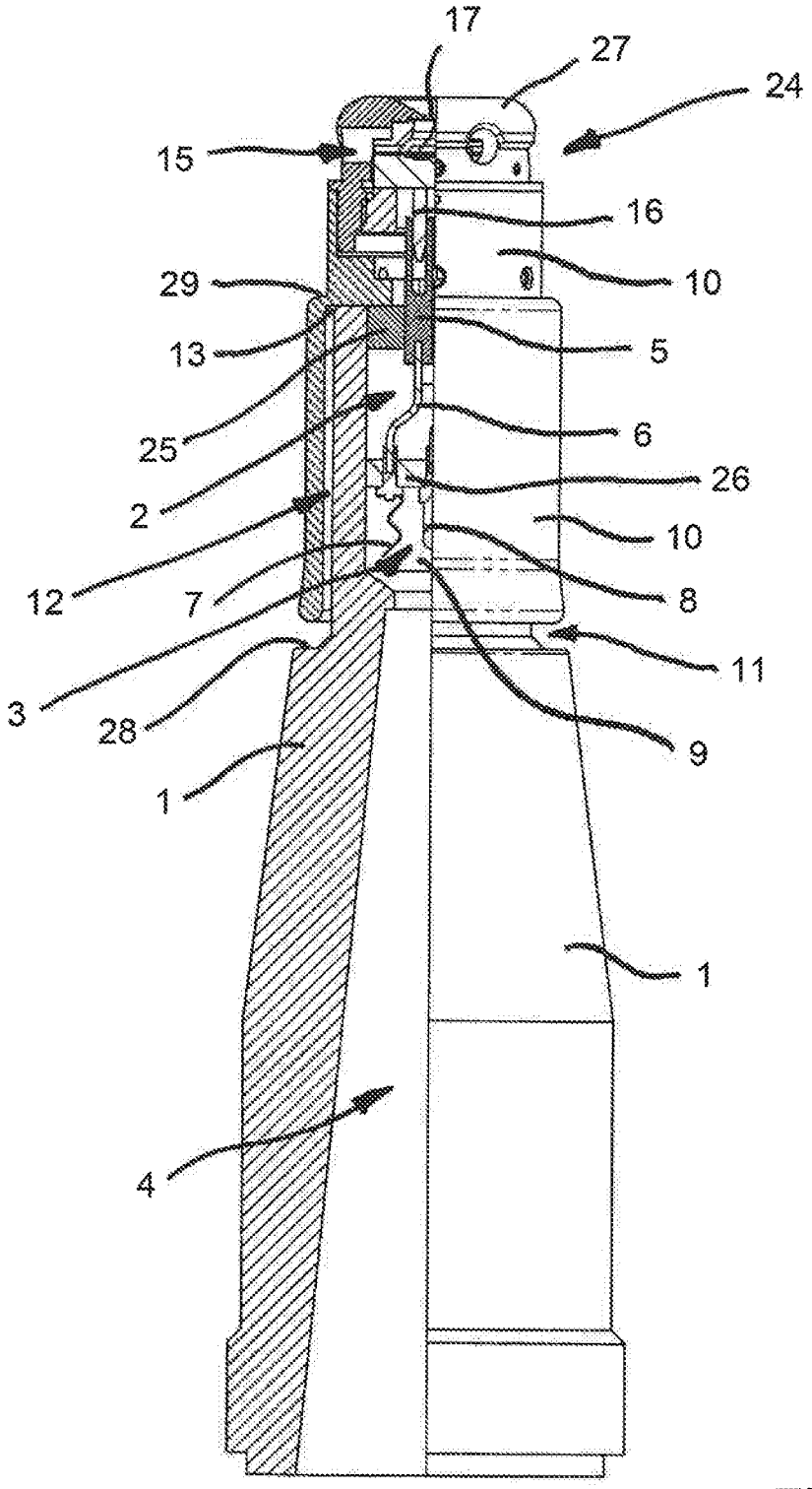
FIG. 1 depicts a partial section through a cathode of a microfocus X-ray tube with a receptacle according to the invention.

In FIG. 1, an embodiment example of a receptacle according to the invention with grid mounting 10 and fitted grid unit 15 of a cathode 24 of the microfocus X-ray tube is represented in a partial section. Here, the left half of the representation is in section and the right half is represented as a view. The boundary of the two representations coincides with the central longitudinal axis of the receptacle.

Figure 2:
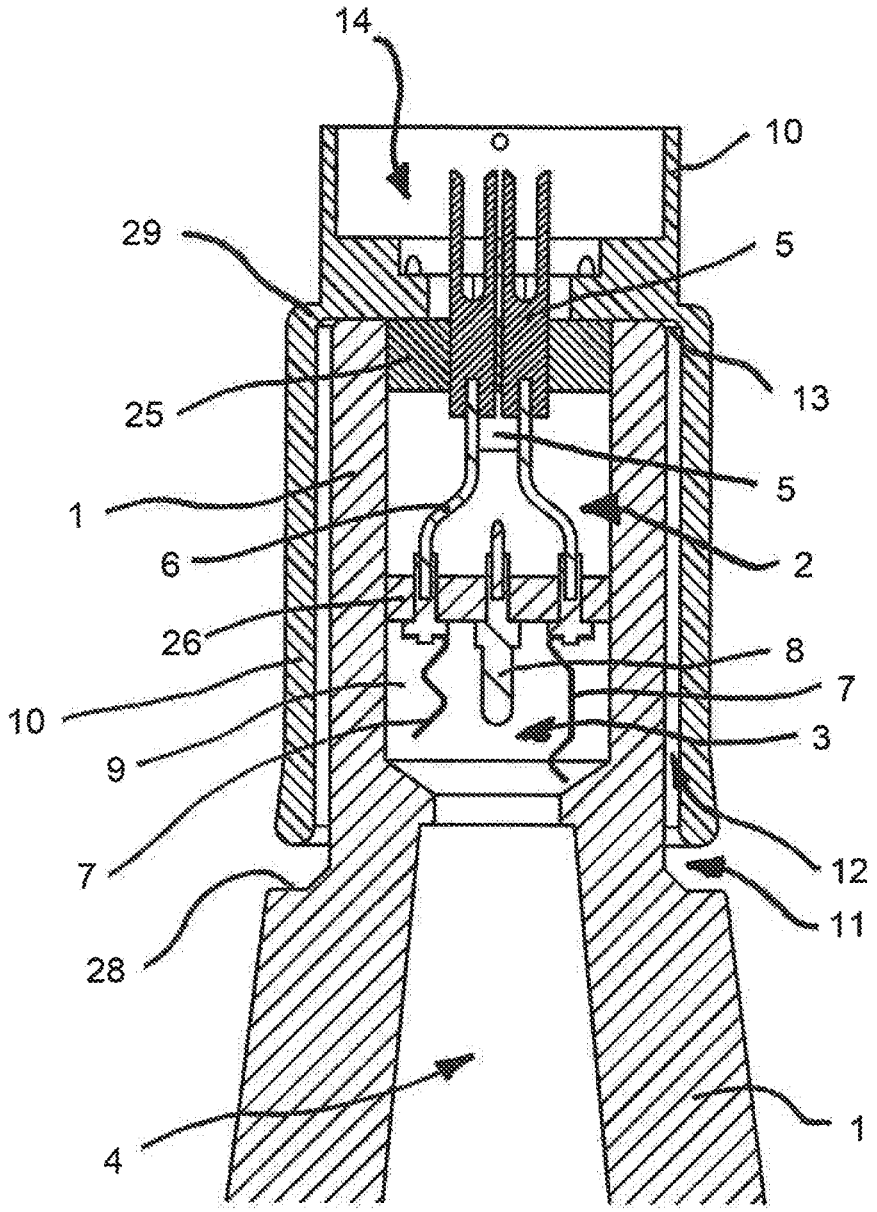
FIG. 2 depicts an enlargement of the contact area of FIG. 1 in full section without filament module.

In the following, the embodiment example of FIG. 1 is described together with FIG. 2. In FIG. 2, an enlarged sectional representation of the upper area of the receptacle of FIG. 1 is represented without the grid unit 15. In this figure, some details can be identified better than in FIG. 1.

The receptacle according to the invention has, as base body, a ceramic insulator 1, which consists of a ceramic material. In the represented embodiment example, this ceramic material is $Al_2O_3$. The ceramic insulator 1 essentially has three sections.

Figure 3:
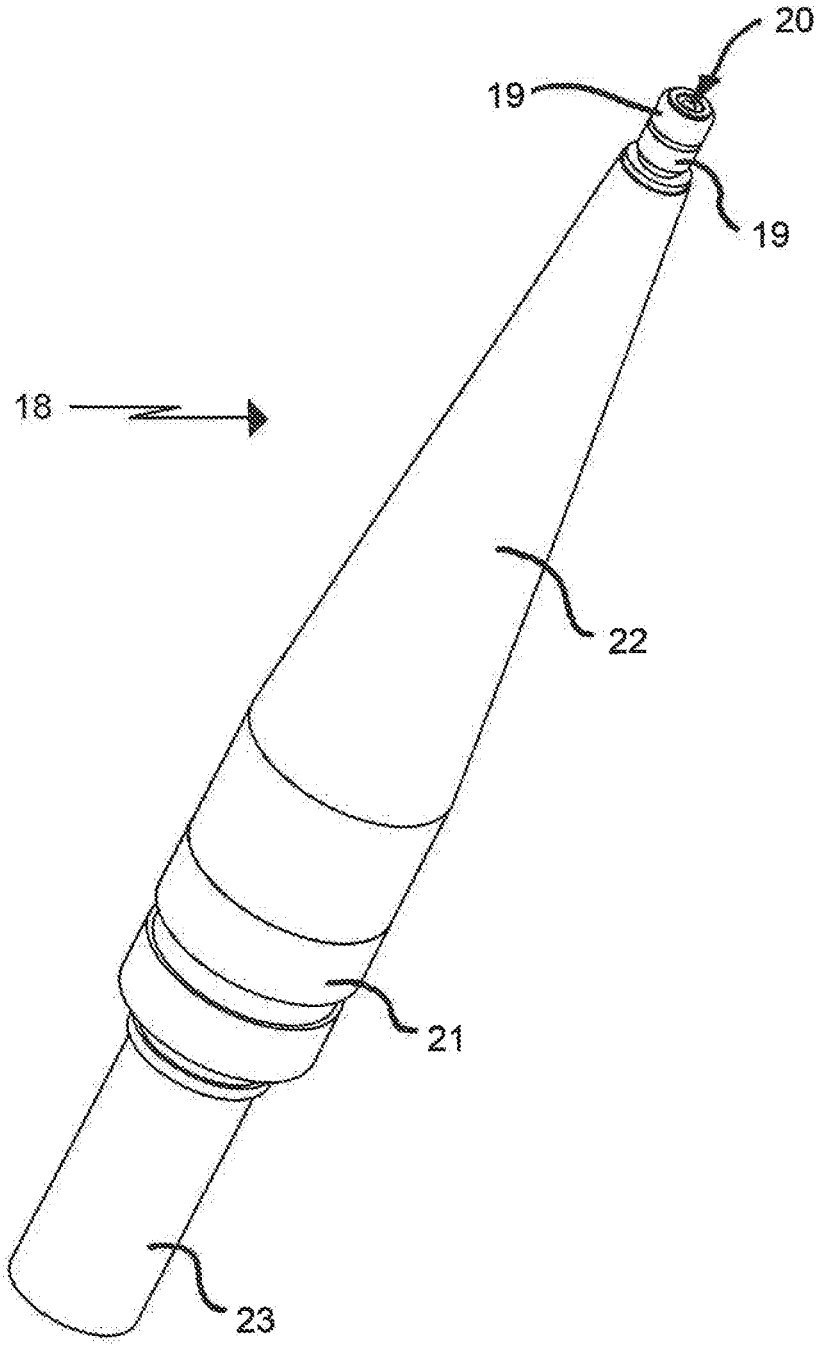
FIG. 3 depicts a scaled-down isometric view of a high-voltage plug connector of a high-voltage cable.

A first cavity 2 is formed in its, in FIGS. 1 and 2, upper section, which is connected to the grid unit 15 in an electrically conducting manner. This first cavity 2 is designed cylindrical. Inside the cavity, two electrical contacts 5 are arranged, which serve to transmit the filament current (in a range from 5-6 A in the embodiment example), which is supplied via a high-voltage cable 23 (see FIG. 3), via electrical conductors (wires) 6, which are also arranged inside the first cavity 2 and are assigned to the electrical contacts 5, to a filament 17 in the grid unit 15. The electrical contacts 5 at the upper end of the first cavity 2 and the electrical conductors 6 at the lower end of the first cavity 2 are each held in a plate (at the top of a closing plate 25 and at the bottom of a contact plate 26) made of an insulating material—in the present embodiment example made of $Al_2O_3$—which are firmly soldered to the ceramic insulator 1. In addition, a third electrical contact 5 is also present, which brings the high voltage (225 kV in the embodiment example) from the high-voltage cable 23 into a grid cap 27 (focusing cup) of the cathode 24. Otherwise, there is no further material present in the first cavity 2.

A second cavity 3 follows the end of the contact plate 26 facing away from the grid unit 15. It is also formed cylindrical with the same diameter as the first cavity 2. At its lower end, facing away from the grid unit 15, it has a short part (in relation to the axial direction seen in comparison with the cylindrical part), which tapers towards the bottom. The surface of the second cavity 3 is provided with a metal layer 9 (here made of an alloy of molybdenum, manganese and nickel). The metal layer 9 was deposited on the inner surface of the ceramic insulator 1 by means of methods known to a person skilled in the art. Two spring contacts 7, which are in contact through the contact plate 26 with the two electrical conductors 6 which transport the filament current, project into the second cavity 3 from the contact plate 26. A third electrical conductor 6 in the first cavity 2 which conducts the high voltage is in contact through the contact plate 26 with an electrically conducting center pin 8, which likewise extends into the second cavity 3 along the central longitudinal axis of the ceramic insulator 1. In the assembled state of the high-voltage plug connector 18 of the high-voltage cable 23, the second cavity 3 serves to make the electrical contact between high-voltage cable 23 and filament 17 or grid cap 27.

Towards the bottom, a third cavity 4 follows the conical part of the second cavity 3, which third cavity 4—except for a cylindrical part that is very short in relation to the axial direction—widens conically towards the bottom and forms a frustoconical part. This frustoconical part serves to receive a rubber cone 22 of the high-voltage plug connector 18 (see FIG. 3) in the assembled state of the high-voltage plug connector 18 in the receptacle of FIGS. 1 and 2.

Hitherto, only the internal shape of the ceramic insulator 1 has been described with reference to its three cavities 2, 3, 4. The description of the outer surface of the ceramic insulator 1 now follows.

In the area of the first and second cavities 2, 3, the outer surface of the ceramic insulator 1 is formed cylindrical. The cylindrical shape extends into the upper area of the third cavity 4. There, the ceramic insulator 1 widens via a circumferential projection 28 and transitions into an area widening conically towards the bottom. Another cylindrical area is then finally connected thereto.

At the upper end of the ceramic insulator 1, a metallic grid mounting 10 is firmly connected to the ceramic insulator 1. The grid mounting 10 is formed axially symmetrical about the central longitudinal axis of the ceramic insulator 1 and centrally has a through hole, through which the electrical contacts 5 pass without a conductive connection. At the upper end, the grid mounting 10 is formed cup-shaped with the result that a receiving recess, the grid receptacle 14 (sec FIG. 2), is available for the insertion of the grid unit 15 into the grid mounting 10. In the installed state of the grid unit 15 in the grid receptacle 14, the grid cap 27 is conductively connected to the grid mounting 10. The filament current is conducted to the filament 17 through filament contact pins 16 on the grid unit 15, which engage in the electrical contacts 5. The grid cap 27 is supplied with high voltage from the high-voltage cable 23 via a corresponding electrical connection, known to a person skilled in the art, to the electrical contact 5 available for this.

In the area of the first and second cavities 2, 3 of the ceramic insulator 1—the lower area of the grid mounting 10—the grid mounting 10 is substantially in the shape of a cylinder barrel and is connected in one piece to the previously-described upper area of the grid mounting 10 via a shoulder 29. At the lower end, the outer surface of the grid mounting 10 widens slightly. Between the inner surface of the lower area of the grid mounting 10 and the outer surface of the ceramic insulator 1, a substantially constant cylindrical air gap 12 is formed. In the area of the shoulder 29, just described, of the grid mounting 10, a triple point 13 is formed (this is actually a ring, which extends concentrically about the central longitudinal axis of the ceramic insulator 1), at which three different media meet: metal of the grid mounting 10, ceramic of the ceramic insulator 1 and air/vacuum of the air gap 12. Between the lower end of the grid mounting 10 and the projection 28 of the ceramic insulator 1, there is a space in the axial direction which leads to a circumferential groove 11, In FIG. 3, a high-voltage plug connector 18 with high-voltage cable 23 (not to scale with FIGS. 1 and 2) attached thereto is represented. In its upper end area remote from the cable, the high-voltage plug connector 18 has two ring contacts 19 that are electrically insulated from each other, which, in the assembled state of the high-voltage plug connector 18 inside the receptacle according to the invention, supply the filament 17 with the filament current via the two spring contacts 7. At the tip, electrically insulated from the two ring contacts 19, a center contact 20 in the form of a bush is formed, in which, in the assembled state of the high-voltage plug connector 18 inside the receptacle according to the invention, the center pin 8 engages and supplies the grid cap 27 of the cathode 24 with high voltage via this electrical connection. The cabling inside the high-voltage cable 23 and the high-voltage plug connector 18 is known to a person skilled in the art from the state of the art. The high-voltage plug connector 18 is pushed into the third cavity such that the rubber cone 22 is pressed in a form-fitting manner into the third cavity 4. The rubber cone 22 is mounted on a fixed threaded part 21 of an HV flange, which is made from stainless steel. The surface contact between the wall of the third cavity 4 of the receptacle and the surface of the rubber cone 22 is produced by screwing the threaded part 21 of the HV flange on a component part of the microfocus X-ray tube, which is arranged fixed in position relative to the ceramic insulator 1, by means of 4 screws (which are not represented).

Through the design according to the invention of the receptacle, the field strengths developing in operation—when the high-voltage plug connector 18 is assembled—can be very greatly reduced with the result that, in spite of the use of ceramic instead of epoxy resin for the ceramic insulator 1, the risk of voltage flashovers is negligible, even when high voltages of 320 kV are applied. Even at the most problematic spring contacts 7, field strengths of less than 6 kV/mm are achieved at a voltage of 225 kV. This is achieved by the combination according to the invention of spring contacts 19 on the receptacle in conjunction with ring contacts 7 on the high-voltage plug connector 18, a very long grid mounting 10 and the internal metallization of the second cavity 3 of the ceramic insulator 1 by means of the metal layer 9.

LIST OF REFERENCE NUMBERS

1 ceramic insulator
2 first cavity
3 second cavity
4 third cavity
5 electrical contact
6 electrical conductor (wire)
7 spring contact
8 center pin
9 metal layer
10 grid mounting
11 circumferential groove
12 air gap
13 triple point
14 grid receptacle
15 grid unit
16 filament contact pin
17 filament
18 high-voltage plug connector
19 ring contact
20 center contact
21 threaded part for HV flange
22 rubber cone
23 high-voltage cable
24 cathode
25 closing plate
26 contact plate
27 grid cap (focusing cup)
28 projection
29 shoulder

We claim:

1. An electrical receptacle comprising:

a first end configured for receiving a high-voltage plug connector of a high-voltage cable and a second end configured for receiving a microfocus X-ray tube with a cathode, the cathode having a filament and a grid cap both of which are made of metal, wherein the receptacle comprises a ceramic insulator having a first cavity, a second cavity and a third cavity, the first cavity being formed at the second end in which electrical contacts are provided and configured for electrical connection with the filament and the grid cap, the electrical contacts being electrically coupled to electrical conductors within the first cavity;

wherein the second cavity is formed between the first and third cavities, the second cavity configured for housing spring contacts for supplying current to the filament and a center pin configured for supplying voltage to the grid cap, the spring contacts and center pin being connected to the electrical conductors and arranged for connection to the high-voltage plug connector, and wherein an interior surface forming the second cavity is covered by a metal layer;

wherein the third cavity is formed at the first end of the receptacle and is shaped and dimensioned to conform to and provide a precise interface connection with the high-voltage plug connector in an inserted state; and wherein the ceramic insulator has a grid mounting which, in an installed state, is conductively connected to the grid cap of the cathode, and the first cavity and the second cavity are surrounded in a radial direction by the grid mounting, wherein between the grid mounting and the ceramic body, an air gap is formed in the radial direction, and wherein at an end of the grid mounting that is remote from the filament, a circumferential groove is provided in an axial direction between the grid mounting and the ceramic insulator.

2. The electrical receptacle according to claim 1, wherein the second cavity is formed cylindrically over a majority of its axial length.

3. The electrical receptacle according to claim 1, wherein the third cavity is formed frustoconical over a majority of its axial length.

4. A plug connection comprising the receptacle and the high-voltage plug connector according to claim 1, wherein the high-voltage plug connector includes a first area having one or more ring contacts, and a second area having a shape which, in an assembled state, contacts in a form-fitting manner with the third cavity of the ceramic insulator of the receptacle, and wherein the first area of the high-voltage plug connector, in the assembled state, is arranged in the second cavity of the ceramic insulator of the receptacle.

5. The plug connection according to claim 4, wherein the second area of the high-voltage plug connector has a rubber cone and/or the second area of the high-voltage plug connector is frustoconical.

6. The electrical receptacle according to claim 1, wherein electrical receptacle is configured to receive an applied high voltage of at least 160 kV.

7. The electrical receptacle according to claim 1, wherein the electrical receptacle is configured to receive an applied high voltage of at least 250 kV.

8. The electrical receptacle according to claim 1, wherein the electrical receptacle is configured to receive an applied high voltage of at least 320 kV.

9. The plug connection according to claim 4, wherein the plug connection is configured to receive an applied high voltage of at least 160 kV.

10. The plug connection according to claim 4, wherein the plug connection is configured to receive an applied high voltage of at least 250 kV.

11. The plug connection according to claim 4, wherein the plug connection is configured to receive an applied high voltage of at least 320 kV.

* * * * *